US006910751B2

(12) United States Patent
Gröninger et al.

(10) Patent No.: US 6,910,751 B2
(45) Date of Patent: Jun. 28, 2005

(54) METHOD OF CONTROLLING AN INKJET PRINTER, AND INKJET PRINTHEAD SUITABLE FOR THE USE OF THIS METHOD, AND AN INKJET PRINTER PROVIDED WITH THIS PRINTHEAD

(75) Inventors: Mark Alexander Gröninger, Venlo (NL); Pieter Gijsbertus Maria Kruijt, Eindhoven (NL); Hans Reinten, Velden (NL); Ronald Herman Schippers, HR Venlo (NL); Johannes Mathieu Marie Simons, Venlo (NL)

(73) Assignees: Kumiai Chemical Industry Co., Ltd., Tokyo (JP); National Institute of Agrobiological Sciences, Ibaraki (JP)

( * ) Notice: Subject to any disclaimer, the term of this patent is extended or adjusted under 35 U.S.C. 154(b) by 56 days.

(21) Appl. No.: 10/611,935

(22) Filed: Jul. 3, 2003

(65) Prior Publication Data

US 2004/0125158 A1 Jul. 1, 2004

(30) Foreign Application Priority Data

Jul. 5, 2002 (NL) ..... 1021012

(51) Int. Cl.[7] ..... B41J 29/38
(52) U.S. Cl. ..... 347/12; 347/19
(58) Field of Search ..... 347/12, 19, 40, 347/48, 54

(56) References Cited

U.S. PATENT DOCUMENTS

| | | | | |
|---|---|---|---|---|
| 4,414,553 A | * | 11/1983 | Perna | 347/40 |
| 4,521,786 A | | 6/1985 | Bain | |
| 5,757,392 A | | 5/1998 | Zhang | |
| 5,966,148 A | * | 10/1999 | Rogers et al. | 347/40 |

FOREIGN PATENT DOCUMENTS

| | | | | |
|---|---|---|---|---|
| DE | 33 19 353 A1 | | 11/1984 | |
| EP | 0 790 126 A1 | | 8/1997 | |
| EP | 0 931 652 A2 | | 7/1999 | |
| EP | 1 013 453 A2 | | 6/2000 | |
| EP | 1013453 A2 | * | 6/2000 | B41J/2/19 |

* cited by examiner

*Primary Examiner*—Stephen D. Meier
*Assistant Examiner*—Ly T. Tran
(74) *Attorney, Agent, or Firm*—Birch, Stewart, Kolasch & Birch, LLP

(57) ABSTRACT

A method of controlling an inkjet printer containing at least two substantially closed ducts in which ink is present, which includes actuating an electro-mechanical transducer whereby the pressure in a first duct is increased, and a pressure change in another duct is also generated by said actuation, whereby an electro-mechanical transducer is deformed as a result of the pressure change, said electrical transducer generating an electrical signal, and measuring the electric signal.

7 Claims, 4 Drawing Sheets

METHOD OF CONTROLLING AN INKJET PRINTER, AND INKJET PRINTHEAD SUITABLE FOR THE USE OF THIS METHOD, AND AN INKJET PRINTER PROVIDED WITH THIS PRINTHEAD

This non-provisional application claims priority under 35 U.S.C. § 119(a) on patent application Ser. No. 1021012 filed in The Netherlands on Jul. 5, 2002, which is herein incorporated by reference.

BACKGROUND OF THE INVENTION

1. Field of the Invention

The present invention relates to a method of controlling an inkjet printer containing at least two substantially closed ducts in which ink is present, comprising:

actuating an electro-mechanical transducer whereby the pressure in a first duct is increased and a pressure change in another duct is also generated by the actuation. The present invention also relates to an inkjet printhead suitable for the use of this method and an inkjet printer provided with such a printhead.

2. Background Art

A method of this kind is known from EP 0 790 126. The known method is used in a printhead for an inkjet printer wherein the printhead comprises a duct plate in which a number of parallel grooves are formed in the longitudinal direction, each groove terminating in an exit opening or nozzle. The duct plate is covered by a flexible plate so that the grooves form a plurality of substantially closed ink ducts. A number of electro-mechanical transducers are provided on the flexible plate at the ducts so that each duct is confronted by one or more of the transducers. The transducers, in this case piezo-electric transducers, are provided with electrodes. When a voltage is applied in the form of an actuation pulse across the electrodes of a piezo-electric transducer of this kind, the result is a sudden deformation of the transducer in the direction of the associated duct, resulting in the pressure in the duct being suddenly increased. As a result, a drop of ink is ejected from the nozzle.

On the side remote from the duct plate, the transducers are supported by a carrier member. The printhead is also provided with a number of connecting elements which connect the carrier member via the flexible plate to the duct plate. These connecting elements serve to increase the mechanical strength of the printhead so that an applied actuation pulse will also always result in the required pressure rise and thus the required drop ejection, i.e. a drop ejection with which the drop, for example, has a previously known size and/or a previously known speed.

The known method, however, has a significant disadvantage. Despite the rugged construction, it is not possible to completely prevent the actuation of a piezo-electric transducer of a first duct from also having an influence on the position in another duct, particularly a neighboring duct. The reason for this is that the actuation causes the piezo-electric transducer to expand, so that mechanical forces are transmitted to the carrier member. Since the carrier member is, in turn, connected to the piezo-electric transducers of the other ducts, these forces will be transmitted to these transducers. This mechanical actuation of these transducers will result in a pressure change in the other ducts, and this pressure change is particularly noticeable in neighboring ink ducts. In many cases, this pressure change increases the closer a neighboring duct is to the duct where the first piezo-electric transducer is electrically actuated. The result of this pressure change is that the drop ejection process in another duct of this kind is adversely influenced. This is also termed cross-talk and may be manifested in a deviant drop size, drop speed, ejection time, and so on. Such deviations will finally result in print artefacts or irregularities, which are visible in varying degrees depending on the nature of the deviation.

SUMMARY OF THE INVENTION

The object of the present invention is to obviate the above-described problems by deforming an electro-mechanical transducer as a result of the pressure change, which generates an electrical signal, and measuring the electric signal.

The method according to the present invention makes use of the fact that a pressure change in the other duct will result in the deformation of an electro-mechanical transducer operatively connected to the duct. In actual fact, this transducer is then used as a sensor in order to record the pressure change in a duct as a result of actuation of another duct. This "sensor" transducer could, for example, be the same electro-mechanical transducer present for normal control of the neighboring duct. The deformation of the sensor transducer will result in the generation of an electrical signal by said transducer. It is precisely this signal which is measured by the method according to the present invention. This signal gives clear information as to the degree of cross-talk. If the signal is very strong, then the effect of the cross-talk is considerable. This could have the effect, for example, that the other duct does not print so that print artefacts might occur. If the signal is only very weak, this means that there is practically no influence, if any, on the other duct, so that printing can be carried out ordinarily with such duct. By using the method according to the present invention cross-talk can at all times be reduced to a non-perceptible level so that there is no adverse influence on the print quality.

European Patent Application EP 1 013 453 discloses a method in which the electro-mechanical transducer is used as a sensor to measure the state of an ink duct. In this method, after the end of the actuation pulse, the transducer is used as a sensor to measure the pressure waves in the same duct. This known method is used to check the state of the controlled duct so that it is possible to decide whether any repair action is to be carried out. However, it has never been known to measure the pressure change in another duct after actuation of an electro-mechanical transducer in a specific duct.

In one embodiment of the method of the present invention, a time suitable for ejecting an ink drop from a neighboring duct is determined on the basis of the measured signal. It has been found that on the basis of the measured signal it is possible to find a time suitable for ejecting a drop from the neighboring duct. The pressure change in a neighboring duct has the form of a pressure wave, possibly similar to a damped sine wave. Thus the influence of the pressure change in the neighboring duct on any drop ejection process in that duct is not constant. Such influence varies with time and finally is reduced to zero if the pressure wave is completely damped. It has been found that before the pressure wave is completely damped there are one or more times at which the influence of the pressure change is such that it does not result in visible artefacts in the printed image. These times are suitable for ejecting an ink drop from the neighboring duct. These times can be determined by experiment. This can be done simply by initiating cross-talk, for example by ejecting a drop from a neighboring duct and then at a specific time thereafter ejecting a drop from the actual duct. The influence of cross-talk can also be determined by analysing the printed ink drop. By repeating this a number of times, the effective influence of cross-talk as a function of the measured electrical signal can be determined. By storing this in a memory it is always possible to establish the time at which the measured signal may be expected to have no appreciable influence from cross-talk.

In the following embodiment, a time is selected such that the pressure change in the neighboring duct does not appreciably influence the drop formation in that duct. This embodiment makes use of the fact that one or more of the previously mentioned times are "zero-crossings", i.e. times at which the pressure change does not appreciably influence the drop formation. This means that the essential characteristics of the drop, particularly the drop speed, the drop size, the drop shape and the time at which the drop is formed (with respect to the time of actuation of the transducer), are not noticeably influenced. This results in an actuation at a time in the pressure ejection process in which no noticeable print artefacts are expected. A zero-crossing of this kind can be determined by simple experiments, for example by measuring each of the essential characteristics of an ink drop as a function of the time of actuation with respect to actuation of a neighboring duct (to induce cross-talk).

In one embodiment of the present method, a separate electro-mechanical transducer is used at each of the ducts. A method of this kind is advantageous because each duct can be actuated by its own electro-mechanical transducer and, if required, measured with the same electro-mechanical transducer. This simplifies actuation of the individual ducts and measurement of the electric signals generated by the transducers in response to a pressure change in a duct.

It should be noted that cross-talk can occur not only when the pressure is raised in a duct to such an extent as to lead to ejection of an ink drop. A pressure change in another duct can also result from a different type of actuation not directed to the ejection of an ink drop but, for example, at repairing an ink duct, or checking the action of the electro-mechanical transducer, or filling a duct with ink, and so on. This may in turn have a noticeable influence on the drop ejection process in the other duct so that there is nevertheless cross-talk.

Cross-talk incidentally is not restricted to neighboring ducts but, depending on the construction of the inkjet printer, may also be noticeable over longer times. For example, it has been found that inkjet printheads having several rows of nozzles, each row being controlled separately, do exhibit an influence of the control of ducts in one row on the control of ducts in another row. By using the method according to the present invention it is also possible to reduce or even eliminated the effect of this influence.

The method according to the present invention can be implemented in various ways. For example, during the production of an inkjet printer it is possible to carry out measurements according to the present invention and determine specific times suitable for reducing the effect of cross-talk. It is also possible to regularly repeat such measurements for an existing inkjet printer, for example after specific printer loading or at times when the printer is undergoing maintenance. A gradual change of the printer, for example due to ageing of the materials from which the printer is made, may have the result that the times at which cross-talk has no effect will be different. By regularly determining these times it is possible to make optimal use of the method according to the present invention at all times. In another embodiment, the effect of the actuation of one duct in a neighboring duct is measured and at the same time a time is determined which is suitable for ejecting an ink drop from the neighboring duct. Real-time implementation of this kind can be carried out by using a closed loop control as is adequately known from the prior art.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE INVENTION

Figure 1:
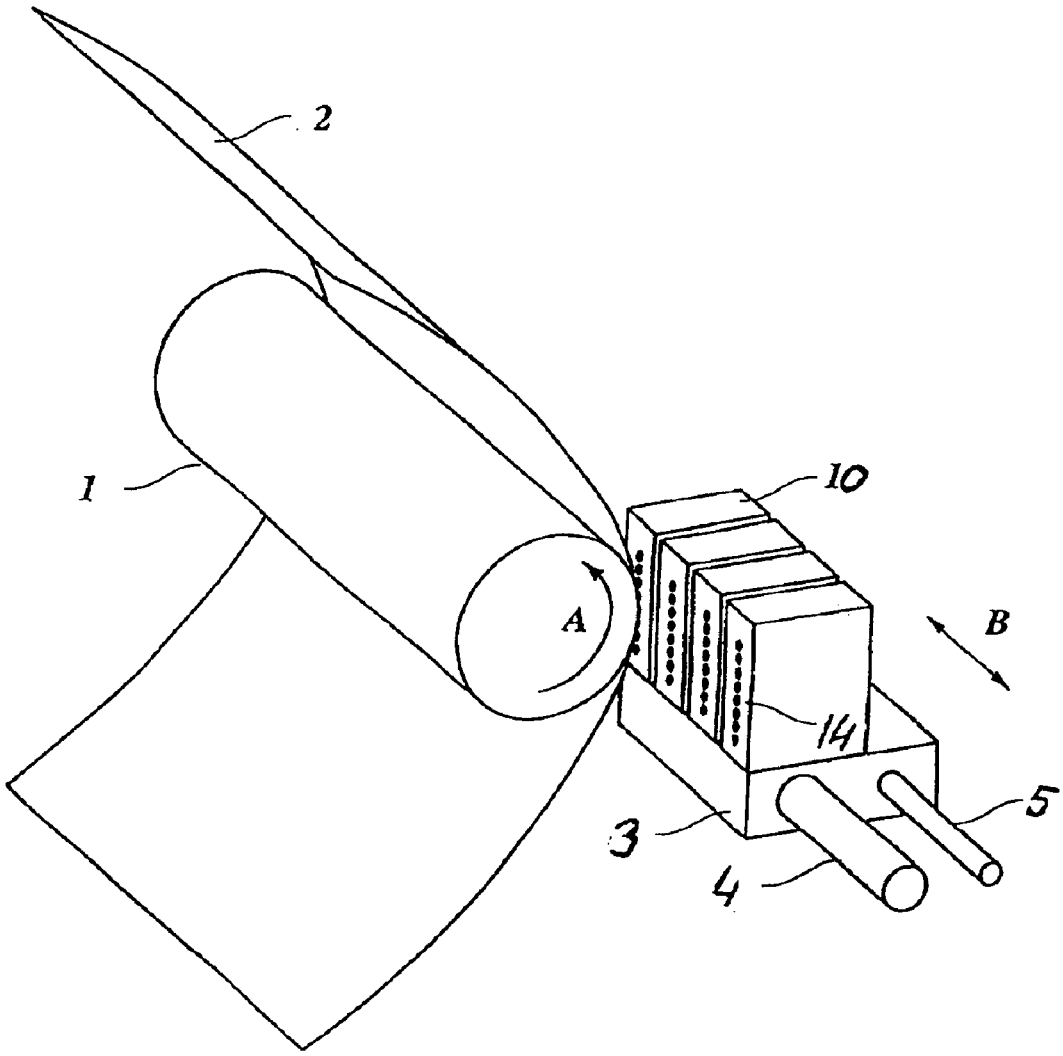
FIG. 1 is a diagram showing an inkjet printer.

FIG. 1 diagrammatically illustrates an inkjet printer. In this embodiment, the printer includes a roller 1 which supports a receiving medium 2. Four printheads 10 move across the receiving medium. The roller 1 is rotatable about its axis as indicated by arrow A. A carriage 3 carries the four printheads 10, one for each of the colors cyan, magenta, yellow and black, which can be moved in reciprocation in the directions indicated by the double arrow B, parallel to the roller 1. In this way the printheads 10 can scan the receiving medium 2. The carriage 3 is guided on rods 4 and 5 and is driven by suitable means (not shown). In the embodiment as shown in the drawing, each printhead 10 comprises eight ink ducts, each with its own exit opening 14, which form an imaginary line perpendicular to the axis of the roller 1. In a practical embodiment of the printing apparatus, the number of ink ducts per printhead 10 is many times greater. Each ink duct is provided with a piezo-electric transducer (not shown) and associated actuation and measuring circuit (not shown) as described in connection with FIG. 3. Each of the printheads also contains a control unit for adapting the actuation pulses, i.e., the time when the pulse takes place. In this way, the ink duct, transducer, actuation circuit, measuring circuit and control unit form a system serving to eject ink drops in the direction of the roller 1. It is not essential for the control unit and/or for example all the elements of the actuation and measuring circuit to be physically incorporated in the actual printheads 10. It is also possible for these elements to be located, for example, in the carriage 3 or even in a more remote part of the printer, there being connections to components in the printheads 10 themselves. In this way, these elements nevertheless form a functional part of the printheads without actually being physically incorporated therein. If the transducers are actuated image-wise, an image forms which is built up of individual ink drops on the receiving medium 2.

Figure 2:
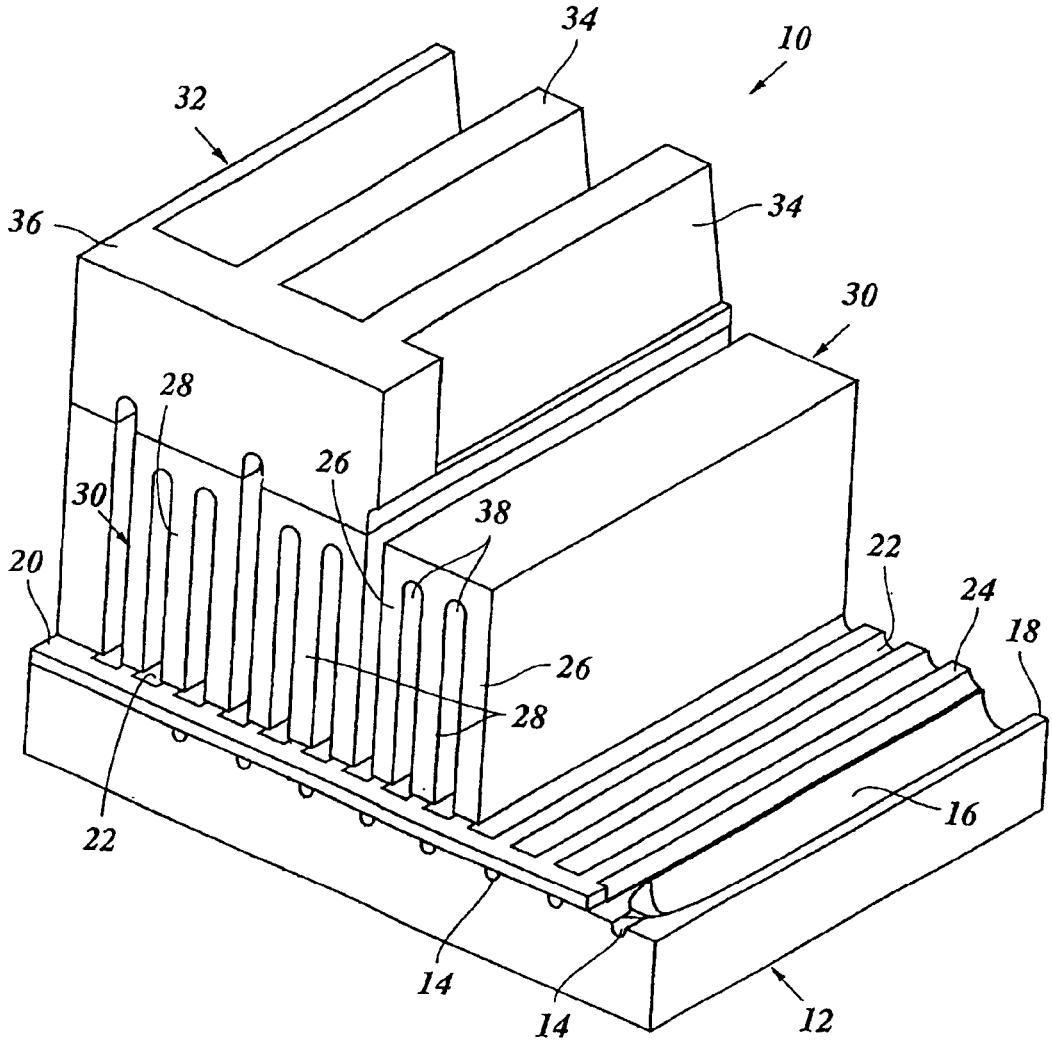
FIG. 2 is a diagram showing an inkjet printhead.

FIG. 2 diagrammatically illustrates a printhead. The printhead 10 illustrated comprises a duct plate 12 defining a row of exit openings 14 and a number of parallel ink ducts 16.

Only one of the ink ducts 16 is visible in FIG. 2. The exit openings 14 and the ink ducts 16 are formed by milling grooves in the top surface of the duct plate 12. Each exit opening 14 is in communication with an associated ink duct 16. The ink ducts are separated from one another by dams 18.

The exit openings 14 and ink ducts 16 are covered at the top by a thin flexible plate 20 rigidly connected to the dams of the duct plate. A number of grooves 22 are formed in the top surface of the plate 20 and extend parallel to the ink ducts 16 and are separated from one another by ribs 24. The ends of the grooves 22 adjoining the exit openings 14 are somewhat offset from the edge of the plate 20.

A row of elongate fingers 26, 28 is so formed on the top surface of the plate 20 that each finger extends parallel to the ink ducts 16 and is connected at the bottom end to one of the ribs 24. The fingers are grouped in triplets, each triplet consisting of one central finger 28 and two lateral fingers 26. The fingers of each triplet are connected at the top and are formed by a block of piezo-electric material in one piece 30. Each of the fingers 26 belongs to one of these ducts 16 and is provided with electrodes (not shown) to which a voltage can be applied in accordance with a print signal. These fingers 26 are piezo-electric transducers which serve as actuators which in response to the applied voltage expand and contract in the vertical direction so that the corresponding part of the plate 20 is bent towards the inside of the associated ink duct 16. As a consequence, the ink (for example aqueous ink, solvent ink or hot melt ink) present in the ink duct is compressed, so that an ink drop is ejected from the exit opening 14. The central fingers 28 are disposed above the dams 18 of the duct plate and serve as support elements which take the reaction forces of the actuators 26. If, for example, one or both actuators 26 belonging to the same block 30 expand, they exert an upward force on the top part of block 30. This force is largely compensated by a tensile force of the support element 28, the bottom end of which is rigidly connected to the duct plate 12 via rib 24 of the plate.

At the top, the blocks 30 bear flat against one another and are covered by a carrier member 32 which is formed by a number of longitudinal bars 34 extending parallel to the ink ducts 16, and by transverse bars 36 which interconnect the ends of the longitudinal bars 34 (only one transverse bar is shown in FIG. 1).

Since the support elements 28 inevitably have a specific elasticity, expansion of one or both actuators 26 of one of the blocks 30 will also cause a slight expansion of the support elements 28 so that a slight bending of the carrier member 32 occurs. This bending force will be transmitted to the adjoining blocks 30 and thus parasitic acoustic waves (cross-talk) will form in the neighboring ink ducts. Cross-talk of this kind can cause problems, particularly if a large number of actuators in neighboring blocks 30 are actuated simultaneously. However, since carrier member 32 consists of separate bars 34 interconnected only at the parallel sides by the cross-bars 36, the bending forces are mainly restricted to the block 30, from which they come. In this way cross-talk can be suppressed but may nevertheless still occur. By the application of the method according to the present invention, as described in connection with FIG. 3 (not shown in FIG. 2), the effect of cross-talk can be further reduced or even completely eliminated.

Figure 3:
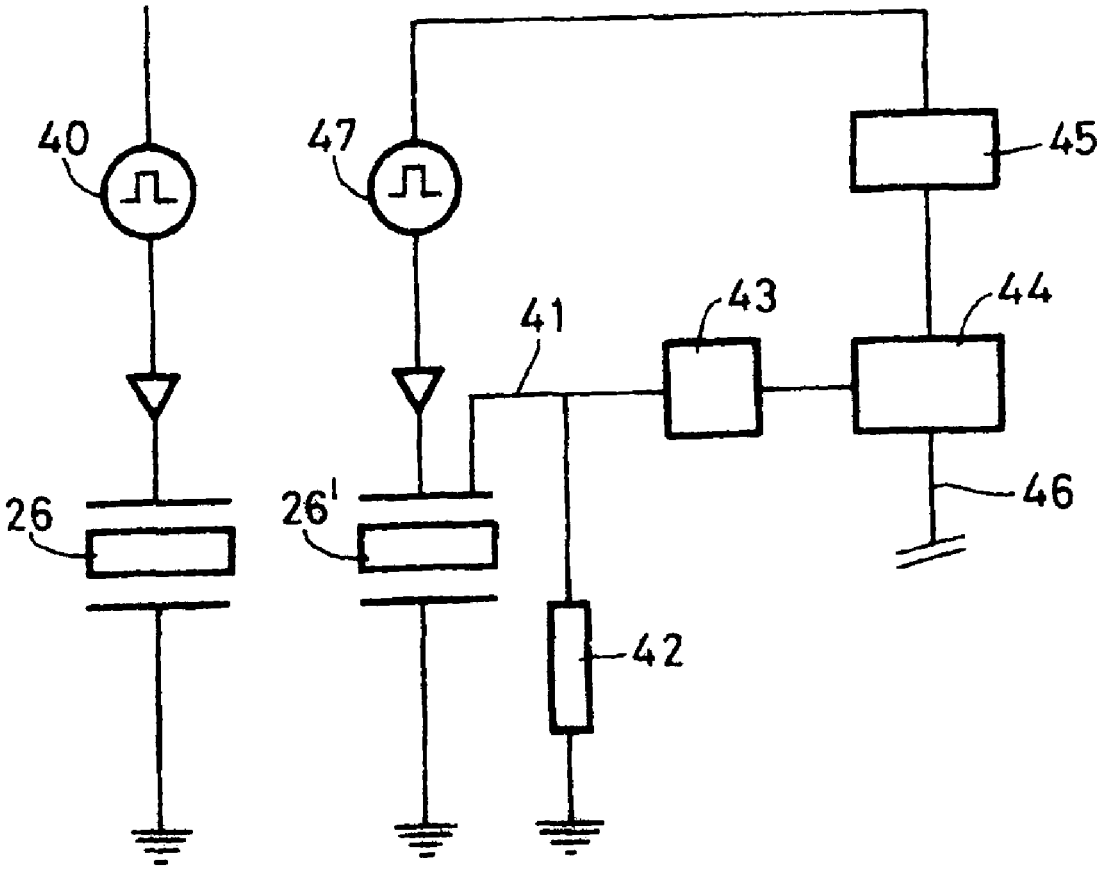
FIG. 3 shows a diagram with which the method according to the present invention can be applied.

FIG. 3 is a diagram with which the method according to the present invention can be used. FIG. 3 shows a first piezo-electric transducer 26 operatively connected to a first ink duct (not shown). This transducer can be controlled by pulse generator 40. A second piezo-electric transducer 26' is also shown, and is operatively connected to another ink duct (not shown), for example the duct directly adjoining the first ink duct. The piezo-electric transducer 26' is connected via line 41 to resistor 42 and A/D converter 43. The latter is in turn connected to the control unit 44 provided with a processor (not shown). Control unit 44 is connected to D/A converter 45, which can deliver signals to pulse generator 47. The control unit is connected via line 46 to other parts of the printer (not shown), particularly a central processor.

The following takes place when the method according to the invention is applied. First of all, piezo-electric transducer 26 is controlled via pulse generator 40 to eject an ink drop from a first ink duct. As a result of the energization of transducer 26, a pressure change also takes place in the neighboring ink duct, which pressure change will result in a deformation of piezo-electric transducer 26'. As a result of this deformation, transducer 26' generates a current which will flow to earth via measuring resistor 42. The voltage thus available across measuring resistor 42 is fed to A/D converter 43, which transmits this voltage as a digital signal to control unit 44. This control unit analyses the signal and in this embodiment determines one or more zero-crossings of the cross-talk signal by reference to a model stored in its memory (not shown). This zero-crossing is remembered and taken into account in the control of transducer 26' when an ink drop must be ejected from this neighboring duct. The control of transducer 26' is initiated by control unit 44 which transmits a signal to D/A converter 45 which transmits the signal in analogue form to pulse generator 47. Finally, this pulse generator sends a pulse to transducer 26' suitable to actuate the latter so that an ink drop is ejected from the corresponding duct. Thus transducer 26' is provided with a measuring circuit, via line 41, and a control circuit, which in this embodiment partially overlap one another.

In this embodiment, not only is transducer 26' provided with its own measuring circuit, but all the piezo-electric transducers of corresponding printheads have a circuit of this kind. In order to maintain clarity, the other measuring circuits and piezo-electric transducers have not been shown. This embodiment enables real-time decisions to be taken as to whether cross-talk is to be taken into account and how this effect can be compensated.

In another embodiment, the printhead comprises just one or a few measuring circuits for the many tens or hundreds of transducers. In this embodiment, it is possible to check all the transducers at regular intervals, for example automatically when servicing of the printer, in order to determine the effect of cross-talk on individual transducers. This information can then be taken into account in the printing of an image.

In another embodiment, the printer itself does not contain a measuring circuit but measurement according to the present invention is carried out when the printer is produced. In certain cases, in fact, a single measurement of the influence of cross-talk can yield sufficient information adequately to reduce or even eliminate the effect of cross-talk during the life of the printhead.

Figure 4A:
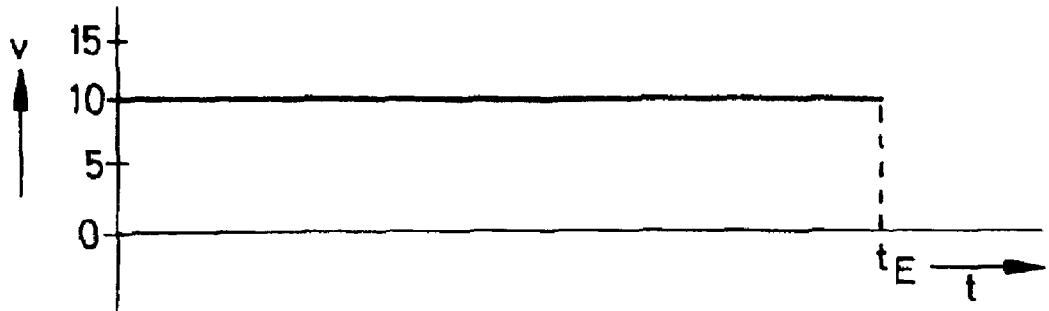
FIG. 4 shows the result of cross-talk on drop speed.
Figure 4B:
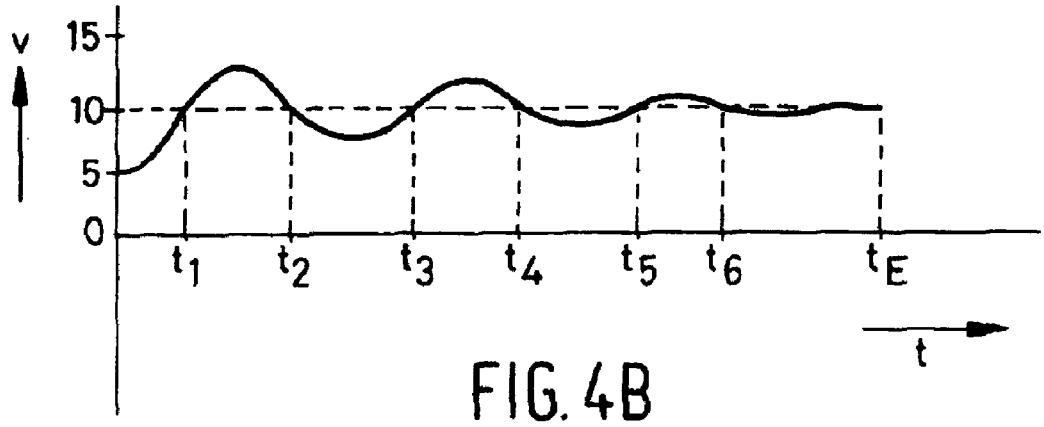

FIG. 4, which is made up of FIGS. 4*a* and 4*b*, shows the possible effect of cross-talk on a drop characteristic, in this case the speed at which an ink drop is ejected from a duct. FIG. 4*a* shows the exit speed in meters per second against time (in arbitrary units) for a specific ink duct K (not shown). This curve is obtained by ejecting drops of ink from this duct at a high frequency, in this case 15 kHz, for a time t=0 to $t=t_E$. The speed of the drops can be measured using a stroboscope as generally known from the art. In the case of FIG. 4*a*, the drops are ejected always at a speed of about 10 ms between t=0 and $t=t_E$. This means that there is no noticeable influence of the actuation of other ducts.

The curve of FIG. 4*b* gives the drop ejection speed of the same duct K. In this case, however, a directly neighboring duct is also actuated for a shorter or longer time after duct K has been actuated. The x-axis shows the time t between actuation of the duct K and actuation of the neighboring duct. This time t is also termed the delay. If both ducts are actuated at the same time (t=0) then there is a considerable effect on the drop ejection speed of duct K. This is the result of parasitic acoustic waves in this duct, i.e. cross-talk. With increasing delay, the influence of the actuation of the neighboring duct decreases. In this case, the drop speed as a function of the delay will be a sinusoidal curve which is completely damped at $t=t_E$. There is then no longer any noticeable influence of the actuation of the neighboring duct. The drop ejection process is then apparently completely concluded so that actuation of the neighboring duct cannot have any further effect. It can be seen that at certain times, namely $t_1$ to $t_6$, there is, in fact, no noticeable effect of the cross-talk, at least with respect to the drop ejection speed: at these times the ejection speed is of course equal to the speed applicable when there is no cross-talk whatever. These times are termed zero-crossings. The position of these times can be take into account during printing. By ejecting a drop at a zero-crossing of this kind there is in fact no noticeable influence of cross-talk and hence no print artefact need form. Account should be taken of the fact that the zero crossing or crossings of other drop characteristics (for example drop size, drop shape, etc) need not be at the same place. If that is the case, then cross-talk will still always have an effect. However, by jetting at a zero-crossing of the most dominant characteristic, i.e. the drop speed for example in a specific application, the noticeable effect of cross-talk can be practically completely or even entirely eliminated.

It should be noted that there are probably still times outside the zero-crossings $t_1$ to $t_6$ at which no visible print artefacts occur due to cross-talk. These times can be determined by analysis of a printed image itself in relation to the measured electrical signal.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling an inkjet printer containing at least two substantially closed ducts in which ink is present, which comprises:

actuating an electro-mechanical transducer of a first ink duct whereby the pressure in the first duct is increased, and a pressure change in a second duct is also generated by said actuation, whereby an electro-mechanical transducer is deformed as a result of the pressure change in the second duct, said electrical transducer generating an electrical signal, and measuring the electric signal, in which method the measuring of the signal generated as a result of the pressure changes in the second duct is in response to actuating the electro-mechanical transducer of the first duct.

2. The method according to claim 1, wherein based on the measured signal, a time is determined suitable for ejecting an ink drop from the second duct.

3. The method according to claim 2, wherein the time is selected so that the pressure change in the second duct does not appreciably influence the drop formation in said duct.

4. The method according to claim 1, wherein each of the ducts has its own electro-mechanical transducer.

5. An inkjet printhead provided with at least two substantially closed ducts for containing ink, which comprises:

an actuation circuit for actuating an electro-mechanical transducer of a first ink duct whereby the pressure in first duct is increased so that an ink drop can be ejected therefrom, and a pressure change is generated in a second duct by said actuation, and a measuring circuit provided for measuring an electric signal generated by the deformation of the electro-mechanical transducer as a result of the pressure change in the second duct, whereby the measuring of the signal generated as a result of the pressure change in the second duct is in response to actuating the electro-mechanical transducer of the first duct.

6. The inkjet printhead of claim 5, wherein each duct has its own electro-mechanical transducer.

7. An inkjet printer provided with the inkjet printhead of claim 5.

* * * * *

UNITED STATES PATENT AND TRADEMARK OFFICE

CERTIFICATE OF CORRECTION

PATENT NO. : 6,910,751 B2
APPLICATION NO. : 10/611935
DATED : June 28, 2005
INVENTOR(S) : Mark Groninger et al.

It is certified that error appears in the above-identified patent and that said Letters Patent is hereby corrected as shown below:

On the Title Page,
Please change:

Item (73) Assignee: Kumiai Chemical Industry Co., Ltd., Tokyo (JP); National Institute of Agrobiological Sciences, Ibaraki (JP)

to:

(73) Assignee: OCÉ-TECHNOLOGIES B.V., Ma Venlo, The Netherlands

Signed and Sealed this

Fourth Day of March, 2008

JON W. DUDAS
*Director of the United States Patent and Trademark Office*